United States Patent [19]

Birdsall

[11] 4,443,966

[45] Apr. 24, 1984

[54] TOY CAR

[76] Inventor: John D. Birdsall, 1262 Sunset Plaza Dr., Los Angeles, Calif. 90069

[21] Appl. No.: 329,174

[22] Filed: Dec. 10, 1981

Related U.S. Application Data

[63] Continuation of Ser. No. 146,228, May 5, 1980, abandoned.

[51] Int. Cl.[3] ..... A63H 17/00

[52] U.S. Cl. ..... 46/206

[58] Field of Search ..... 46/206, 202, 201, 81; 124/31, 17, 16; 24/230 R

[56] References Cited

U.S. PATENT DOCUMENTS

| | | | |
|---|---|---|---|
| 1,877,661 | 9/1932 | Heisler et al. | 46/223 |
| 2,517,084 | 8/1950 | Carver | 46/206 |
| 2,594,527 | 4/1952 | Wechsler | 46/81 X |
| 3,154,062 | 10/1964 | Ryan | 124/31 X |
| 3,181,189 | 5/1965 | Leyden | 24/230 RX |
| 4,345,402 | 8/1982 | Hanson et al. | 46/206 |
| 4,411,098 | 10/1983 | Birdsall et al. | 46/206 |

FOREIGN PATENT DOCUMENTS

| | | | |
|---|---|---|---|
| 1043010 | 9/1966 | United Kingdom | 46/206 |
| 1231843 | 5/1971 | United Kingdom | 46/206 |

*Primary Examiner*—Mickey Yu

*Attorney, Agent, or Firm*—Laff, Whitesel, Conte & Saret

[57] ABSTRACT

A toy car which includes an internal tubular spring retainer which extends from one end of the car to the other, and a coiled spring mounted within the retainer. A key is inserted into the rear end of the retainer to compress the spring, and the key is latched with the retainer after it has been inserted to cock the spring. The key is held in the hand of the operator, and it is squeezed or otherwise moved to unlatch the key from the retainer. This causes the forward end of the spring to move against the forward end of the car chassis, while the rear end of the spring engages the forward end of the key, thereby propelling the car forwardly away from the key, as the key is held stationary in the hand of the operator.

6 Claims, 6 Drawing Figures

10
12
14
16
18
20
22
30
32
33
34
36
38
30a
30b
3
4
6
17

TOY CAR

This is a continuation of application Ser. No. 146,228, filed May 5, 1980 now abandoned.

BACKGROUND

The objective of the invention is to provide a simple and inexpensive toy car which may be propelled at high speed across a table, floor or other surface, merely by inserting a key into the rear end of a tubular spring retainer mounted on the chassis of the car, to compress a spring positioned in the retainer and to cock the spring by latching the key to the retainer. Then, by squeezing or otherwise moving the key, the spring may be uncocked so as to cause the car to be propelled at high speed along the surface away from the key, as described above.

DETAILED DESCRIPTION OF THE ILLUSTRATED EMBODIMENT

Figures 1, 2, 3, 4, 5, 6:
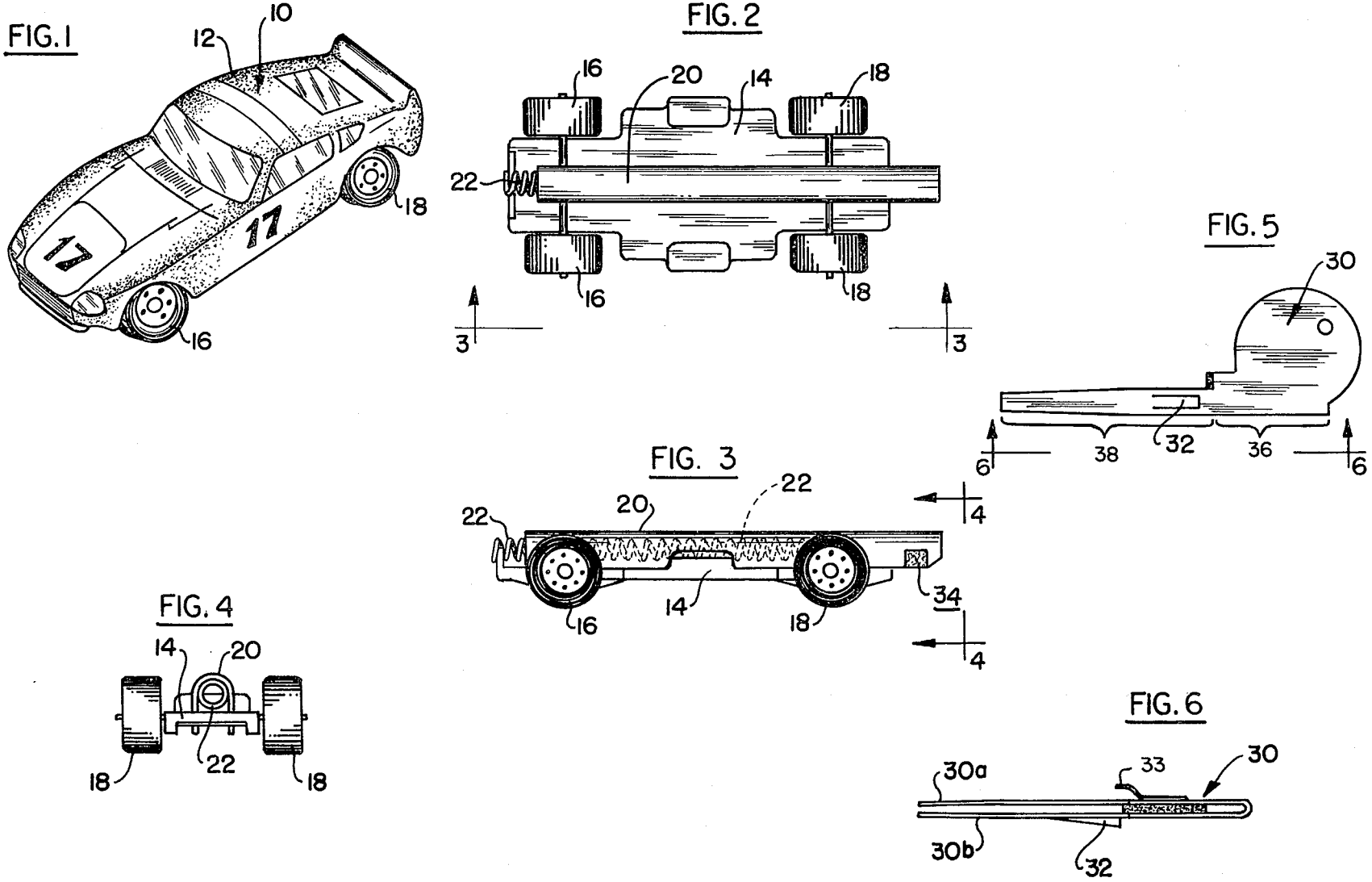
FIG. 1 is a perspective representation of a toy car constructed in accordance with the concepts of the present invention.
FIG. 2 is a plan view of the chassis of the car of FIG. 1.
FIG. 3 is a side elevation of the chassis of FIG. 2 taken along the line 3—3 of FIG. 2.
FIG. 4 is an end elevation of the chassis taken along the line 4—4 of FIG. 3.
FIG. 5 is a side view of a key which is used in conjunction with the toy car of FIGS. 1–4.
FIG. 6 is a bottom view of the key of FIG. 5 taken along the lines 6—6 of FIG. 5.

The toy car of the invention is designated 10 in FIG. 1, and it includes a body 12 which may have any particular configuration to simulate, for example, any known make of sports car or racing car. A chassis 14 is contained within the body 12, and front and rear wheels 16 and 18 are mounted on the chassis.

In accordance with the concepts of the present invention, an elongated tubular retainer 20 is mounted on the chassis 14, and the retainer extends from one end of the chassis to the other. A coil spring 22 is positioned within the retainer 20. The forward end of the coil spring 22 is attached to the chassis 20, whereas the rear end of the coil spring is freely movable within the retainer.

A key 30 (FIGS. 5 and 6) is provided which may be inserted into the rear end of the retainer 20 to move the rear end of spring 22 forwardly in the retainer and compress the spring. Key 30 is inserted into the retainer until a latch 32, mounted on one side of the key engages a slot 34 in the retainer. This action cocks the spring 22 within the retainer, and the spring remains cocked until the key 30 is turned or otherwise operated to release latch 32. For example, as shown in FIG. 6, key 30 may be made up of two bifurcated sections 30*a* and 30*b*, which, when squeezed together, release latch 32 from notch 34.

When the key is held in the hand of the operator, and squeezed to release latch 32, the rear end of the spring 22 bears against the forward end of the key, and the forward end of the spring bears against the chasis 14, causing the car to be propelled forwardly at high speed as the key is held stationary by the operator. In this way, the car is effectively ejected from the key, and moves away from the key at high speed across the floor, table or other supporting surface.

Briefly, in review, a bifurcated key (FIG. 6) has a generally U-shaped longitudinal cross section comprising a spaced parallel pair of plates 30*a*, 30*b*, joined in the back and generally held in a spaced relationship. One of the plates has a detent 32 formed thereon. The other of the plates has an immobilizing means 33 extending therefrom. The key of FIG. 6 is configured to simulate an automobile key having a handle 36 (FIG. 5) and a shaft 38. The shaft 38 of the key may be inserted into the rear end of the tubular housing simply by a linear sliding of the key to bear against the rear end of the spring and to move the rear end of the spring forwardly within the housing, thereby compressing the spring 22 (FIG. 2). The notch 34 in tubular housing 20 and the detent 32 cooperate to interlock the key within the tube. The handle part 36 of the key projects out the back of the vehicle. The detent 32 is released from notch 34 when the handle portion 36 of the spaced parallel plates forming the handle of the key is moved in a particular direction after the spring has been cocked while the immobilizing means 33 on the other of the plates holds it in place.

It will be appreciated that while a particular embodiment of the invention has been shown and described, modifications may be made. It is intended in the claims to cover the modifications which come within the true spirit and scope of the invention.

What is claimed is:

1. A toy vehicle comprising: a chassis; a separate vehicular body supported by said chassis; support wheels mounted on the chassis; an elongated tubular spring-retainer housing mounted on the chassis and extending longitudinally along the chassis from one end thereof toward the other end thereof; and a coil spring mounted in the housing and extending from one end of the housing to the other end of the housing, the forward end of the spring being secured to the chassis at the forward end of the housing, the rear end of the spring being freely movable along the housing, a bifurcated key having a U-shaped longitudinal cross section comprising a spaced parallel pair of plates joined in the back and generally held in a spaced relationship, one of said plates having a detent and the other of said plates having an immobilizing means extending therefrom, said key being configured to simulate an automobile key having a handle and a shaft, said key and housing having complementary contours so that the shaft of the key may be inserted into the rear end of the tubular housing simply by a linear sliding of said key to bear against the rear end of the spring and to move the rear end of the spring forwardly in the housing thereby compressing the spring, the tubular housing and said detent on one plate of the key forming cooperating latching means to interlock within said tube without having to separately manipulate parts of said key and to cause the spring to cock after the key is inserted a predetermined distance into the rear end of the tubular housing, said handle part of said key projecting out the back of the vehicle; the latching means comprising a notch in said housing and said detent forming a mating latch on said shaft, said latching means being released when the portion of the spaced parallel plates forming the handle of the key is moved in a particular direction after the spring has been cocked while said immobilizing means on the other of said plates holds it.

2. The toy vehicle defined in claim 1, in which the immobilizing means on said key is a hook which stabilizes said other plate while the detent on said one plate is moved in said particular direction and the latch is released when the bifurcated plates of the key are squeezed together.

3. An action toy comprising: a body; a tube therein; a normally expanded spring mounted in the tube, one end of the spring being secured adjacent the forward end of the body, the other end of the spring being freely movable within the tube; retaining means disposed on the body; and a resilient key having a first portion which is linearly insertable into a self-latching engagement within the tube, said linear insertion bearing against the free end of the spring and compressing the spring, and a second portion of said key being integral with the first portion of said key for enabling a manual gripping of the key outside the body, the first portion having key holding means on one side for automatically engaging the retaining means and for holding the key latched within the tube when it is inserted therein, said key holding means having a stabilizing hook means on another side for restraining the direction in which said other side may move, the second portion of said key being configured so that when it is squeezed the key holding means moves out of said self-latching engagement with said retaining means while said stabilizing means precludes movement of said other side of said key, which releases the compressed spring to propel the body from the key.

4. A process for propelling a toy vehicle having a body, an elongate opening therein, a coil spring mounted in the opening, and a removable resilient key which is adapted to be inserted into the opening against the force of said spring, said resilient key being a bifurcated member having a latch on one side and a hook on another side, said process comprising:

(a) inserting the key into the body opening with only a linear motion;

(b) pushing the key against the spring during said linear motion until said spring is compressed to store energy;

(c) self-latching the key by capturing said latch and said hook in the body solely responsive to said linear motion and thereby retaining the spring in said compressed, energy-storing condition; and (d) moving a part of the key which projects from said body, said hook stabilizing part of said key so that said moving is concentrated at said latch until said latch becomes unlatched from the body, whereupon the spring will expand propelling the vehicle from the key.

5. The process of claim 4 wherein the key comprises two spaced parallel plate members separated by a block of resilient material, said resilient material being compressed when said plates are squeezed together to actuate or release said latching means, and wherein step (d) includes squeezing the two parallel key plate members toward each other to compress said resilient material and to unlatch the key from the body and thereby propel the vehicle from the key.

6. The process of claim 5 wherein the means for latching the key in the body is a notch located in the body and a detent actuated by one of the parallel key plate members and adapted to engage the notch and wherein step (c) comprises engaging the detent in the notch and step (d) comprises squeezing the key members until the detent disengages from the notch, said resilient means returning said plates to their parallel positions.

* * * * *